US005792979A

United States Patent [19]

Pietro

[11] Patent Number: 5,792,979

[45] Date of Patent: Aug. 11, 1998

[54] TWO-ELEMENT WAD WITH PNEUMATIC DAMPING

[76] Inventor: Pedro Diaz Pietro, Jose Antonio 3., 054701 Pedro Bernardo, Spain

[21] Appl. No.: 701,041

[22] Filed: Aug. 21, 1996

Related U.S. Application Data

[63] Continuation of Ser. No. 379,571, Feb. 2, 1995, abandoned.

[30] Foreign Application Priority Data

Jun. 4, 1993 [ES] Spain ..... 9301229

[51] Int. Cl.[6] ..... F42B 7/08

[52] U.S. Cl. ..... 102/450; 102/451; 102/461; 102/532

[58] Field of Search ..... 102/448–463, 102/520–523, 532

[56] References Cited

U.S. PATENT DOCUMENTS

| | | | |
|---|---|---|---|
| 419,220 | 1/1890 | Scanland | 102/461 |
| 1,691,802 | 11/1928 | Gabel | 102/532 |
| 3,289,586 | 12/1966 | Horn et al. | 102/450 |
| 3,420,178 | 1/1969 | Rempel | 102/453 |
| 3,623,431 | 11/1971 | Hendricks | 102/452 |
| 4,220,090 | 9/1980 | Fackler | 102/532 |
| 4,782,759 | 11/1988 | Hawk | 102/450 |

FOREIGN PATENT DOCUMENTS

| | | | |
|---|---|---|---|
| 422052 | 3/1972 | Australia . | |
| 702530 | 1/1968 | Belgium . | |
| 1140761 | 8/1957 | France | 102/461 |
| 2070268 | 9/1971 | France . | |
| 2343219 | 9/1977 | France . | |
| 171410 | 6/1906 | Germany . | |
| 3507789 | 11/1985 | Germany . | |
| 59337 | 1/1970 | Luxembourg . | |
| 1607552 | 4/1992 | U.S.S.R. . | |
| 1109193 | 4/1968 | United Kingdom | 102/449 |
| 1291700 | 10/1972 | United Kingdom . | |
| WO92/18827 | 10/1992 | WIPO . | |

*Primary Examiner*—Harold J. Tudor
*Attorney, Agent, or Firm*—Ladas & Parry

[57] ABSTRACT

Two-element wad with pneumatic damping designed for the cartridge industry formed by two interchangeable elements connected to each other and which consist of a case and a damper-shutter. The case incorporates a series of foldable flaps and a valve that regulates the damping and injects air. Both the case and the damper-shutter have crosssectional walls and a convexo-concave shape that can absorb radial deformations to the symmetry axis of the wad. The damper-shutter has a four-fold action: it withstands the flexion and deformation of the material, the friction against the walls, and the compression of the air contained in the damper-shutter.

20 Claims, 3 Drawing Sheets

TWO-ELEMENT WAD WITH PNEUMATIC DAMPING

This is a continuation application Ser. No. 08/379,571 filed Feb. 2, 1995, now abandoned.

OBJECT OF THE INVENTION

The object of this application for an Invention Patent is a two-element wad with pneumatic damping, which presents a series of advantages and novelties when compared with the wads currently used in the cartridge sector.

BACKGROUND OF THE INVENTION

According to the current state of the art in the cartridge field, wads are usually manufactured from a single piece of deformable material, due to the need to protect the barrel of the gun against the leading or coppering derived from repeated shots, due to the need to enhance the shot pattern, and due to the need to completely contain the gases created during the combustion of powder.

However, the use of the current wads presents a series of inconveniences, namely the following ones:

- Lack of pattern uniformity when comparing different shots made with the same cartridge, wad, and rifle.
- Damping by bending and deformation of the constituent material, resulting in non-recoverable energy.
- Sudden deformations when the throttling of the gun is reached; the pellets are embedded within the material.
- The amount of energy consumed during these deformations is high, and the friction against the gun barrel is also high.
- Each charge needs a wad with specific dimensions (i.e., each different amount of pellets needs a different wad size, such as different lengths of the cartridge case, even for similar charges).
- The wad has an excessive gunshot, thereby causing appreciation errors to the shooter and third parties.

DESCRIPTION OF THE INVENTION

The two-element wad with pneumatic damping which is the object of this invention is composed of two interchangeable elements (a case and a damper-shutter), which are joined to each other.

The cases incorporates a series of bendable flaps and a damping-regulating, air-injecting valve. Both the case and the damper-shutter have convexo-concave-shaped walls able to absorb radial deformations with respect to the symmetry axis of the wad.

The damper-shutter has a four-fold action; it withstands the bending and deformation of the material, the friction against the barrel, and the compression of the air contained in the damper-shutter.

The main advantages of the present cartridge wad, compared with conventional wads, are the following ones:

- Enhancement of the pattern.
- A need for less energy for a given charge drive.
- The same wad can be adapted to different cartridge case lengths and can house different charges within the same cartridge.
- Different cases and dampers can be interchanged.
- Flexibility to adapt to the barrel throat and to different bores for the same gun bores.
- Perfect gas plugging with reduced friction.

- Smaller embedding of small-shots on the wad material, which makes the wad-charge separation easier.
- A smaller range for the wad.
- Smoother recoil.
- A damping system with energy recovery.

To complement the subsequent description and in an effort to better explain the main characteristics of the invention, a set of drawings is attached to this descriptive report where, as an illustration and without limitation, the most representative details have been included.

DESCRIPTION OF A PREFERRED EMBODIMENT

Figure 1:
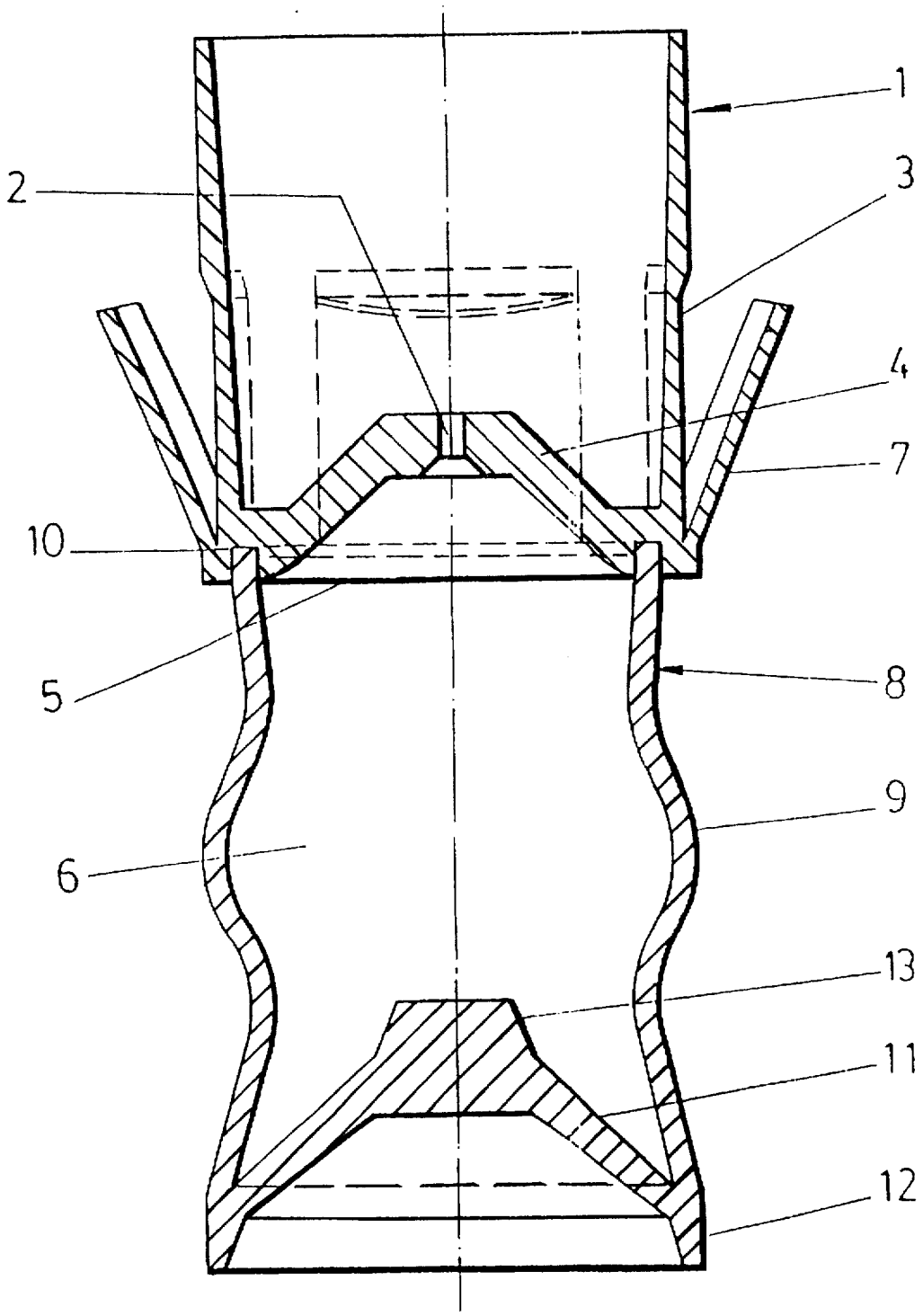
FIG. 1 shows a side cross-sectional view of a preferred embodiment of the invention.
Figure 2A:
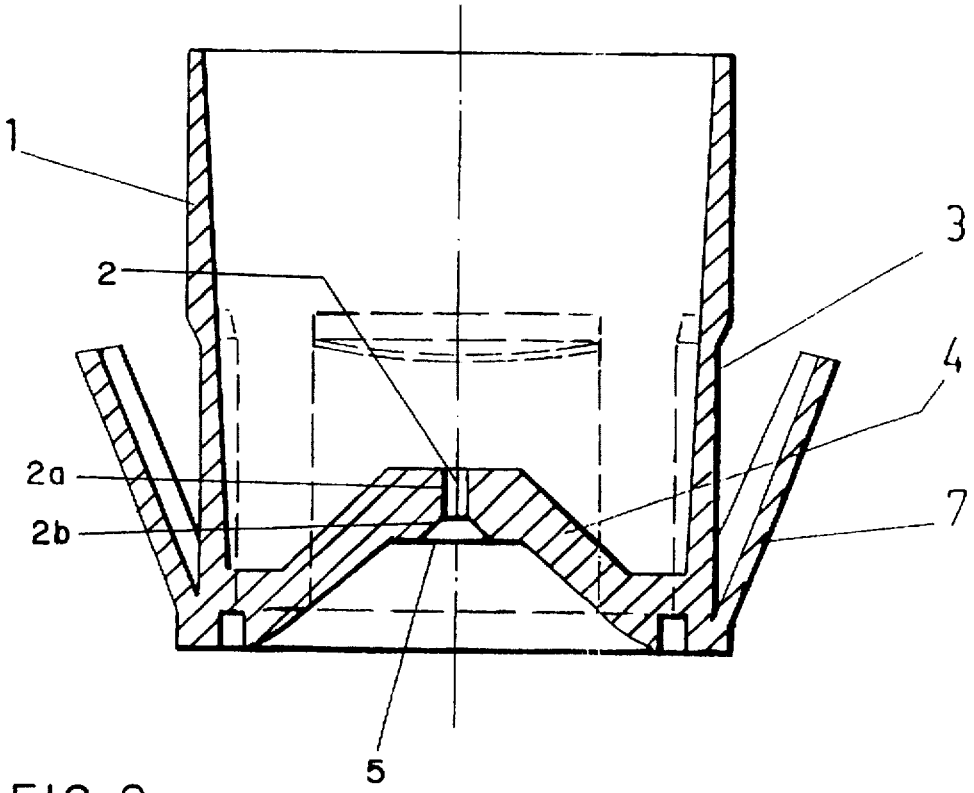
FIG. 2*a* shows a cross-sectional side view of the case.
Figure 2B:
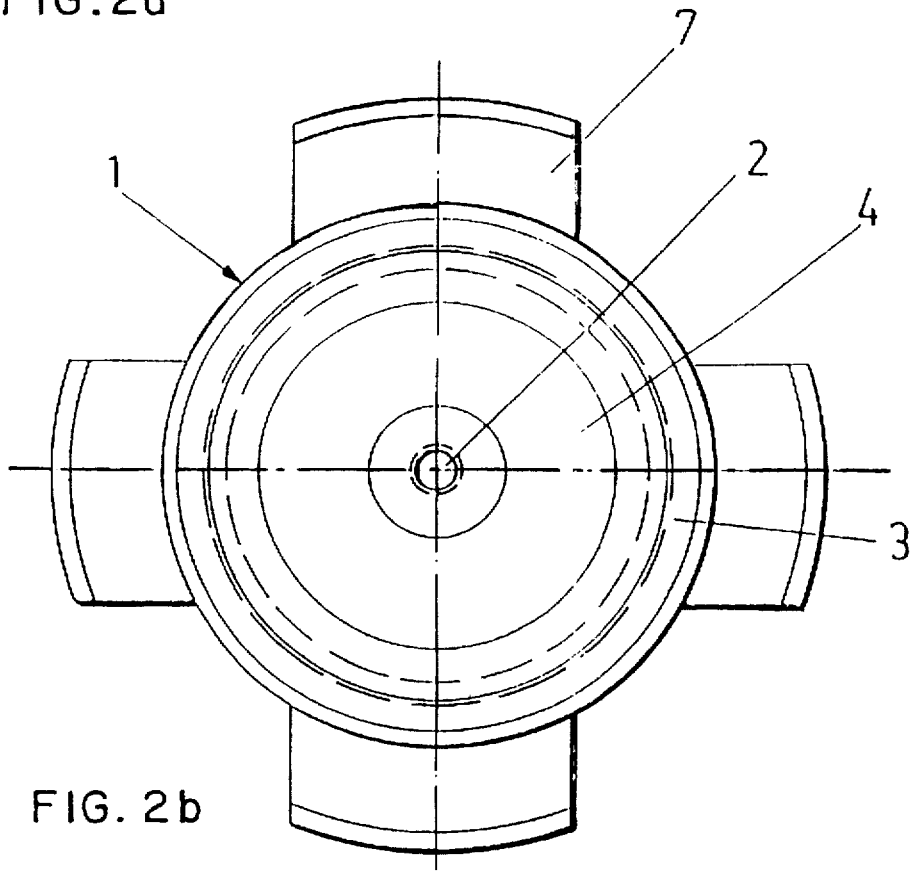
FIG. 2*b* shows a top plan view of the case.
Figure 3A:
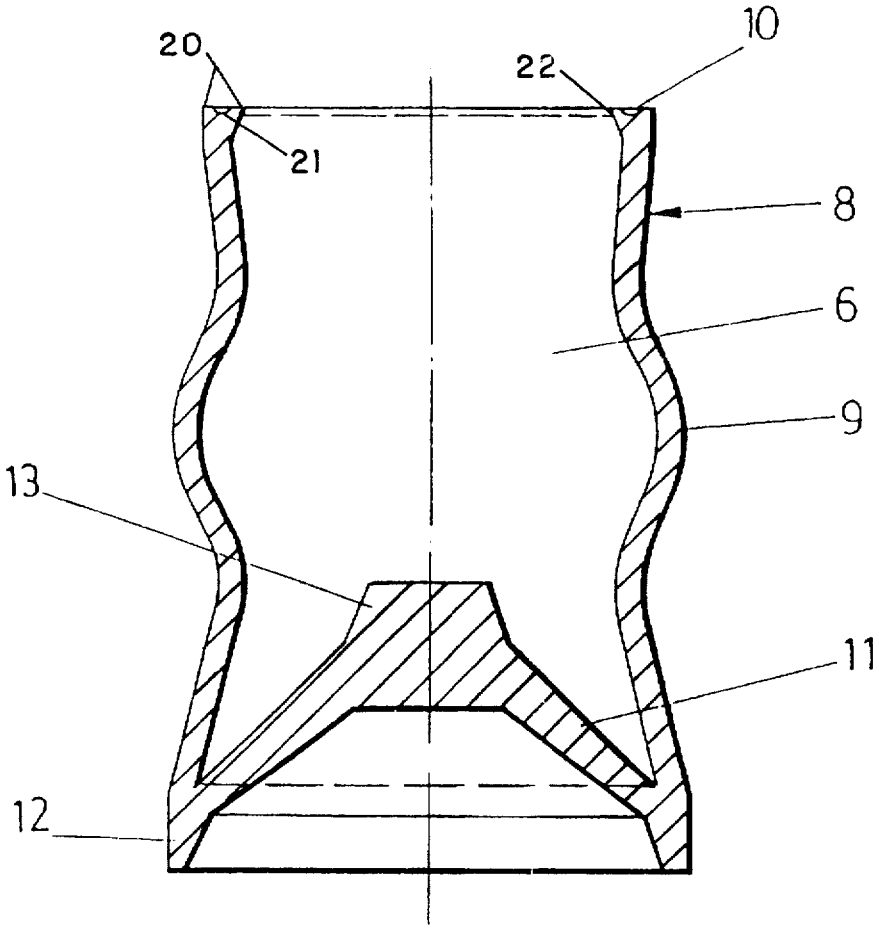
FIG. 3*a* shows a cross-sectional side view of the damper-shutter.
Figure 3B:
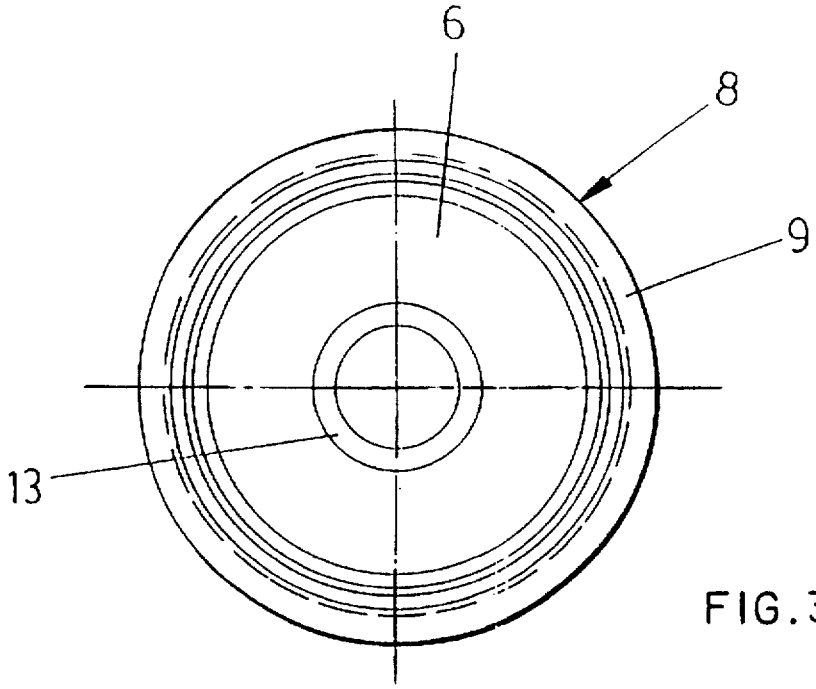
FIG. 3*b* shows a top plan view of the damper-shutter.

In the light of the above-mentioned figures and according to the numbering system adopted, a cartridge wad is formed by two independent elements, the case (1) and the damper-shutter (8). Once assembled, both elements form the cartridge wad itself.

The case (1) is characterized by a cylindrical external appearance, with a series of flaps (7) connected to its lower part. The walls (3) present a series of bores or holes which serve to house such flaps (7).

When the flaps (7) are folded, they are housed in the bores or holes; and the case presents a totally cylindrical external appearance.

The case (1) has smooth inner walls having a frusto-conical shape and opening upwards. The bottom or base (4) has a frusto-conical, convexo-concave shape and forms a circular ring where the inner walls end. The upper side of the base (4) is convex, and the lower side of the base (4) is concave.

The lower area of the case (1) has a ring-shaped groove for receiving the upper edge (10) of the damper-shutter (8). The central area below the lower side of the base (4) has a frusto-conical shape. In turn, the central portion of the base (4) houses a valve (2) formed by two non-passing holes (an upper hole (**2*a*) and a lower hole (2*b*)) coinciding with a thin membrane (5) made of the same material as the case. The upper hole (2*a*) of the valve (2) can have a cylindrical or prismatic shape, while the lower hole (2*b***) can be frusto-conical or of a similar shape. The dimensions and the thickness of the membrane can vary depending on the needs.

It should also be noticed that the membrane (5) can be replaced by a cap able to slide throughout the seat forced by the pressure and able to act similarly to the membrane. The membrane (5) can also be replaced by a hole regulating the air throttle as needed.

The damper-shutter (8) has a vase-shape external appearance, with a chamber (6) delimited by bellow-shaped walls (9) or sinusoidally curved walls with slightly rounded inflections. The walls (9) are supported by a relatively straight wall (12), which acts as the closure or base of the bellow. The damper-shutter (8) has a convexoconcave bottom formed by two frusto-conical shapes (11) and (13) connected to each other. The upper side of the damper-shutter (8) bottom is convex, and the lower side of the damper-shutter (8) bottom is concave.

The upper part or edge (10) of the damper (8) has a doublelipped edge with a ring-shaped slot (21) for improving water-tightness when the upper edge (10) supports a flat surface. The upper edge (10) also has a ring-shaped rib (22) which matches the case (1), thus preventing the damper-shutter (8) and the case (1) from being easily detached after they have been connected.

This invention has tried to solve all of the inconveniences presented by current, state-of-the-art wads. For this purpose, a two-element wad has been selected. Both elements (1) and (8) will be manufactured by injection or blowing, and both will be made of plastic, non-rigid, or semi-rigid material.

After both elements of the wad have been assembled, the wad can be installed into the cartridge.

When the wad is introduced into the cardboard case, the side flaps (7) are folded inside their housing. The flaps (7) remain in this condition until the wad comes out from the gun. Then, the flaps unfold to serve as stabilizers and brakes.

When the wad is located inside the cartridge and rests against the powder charge, the damper-shutter (8) is flexed and the air inside the cartridge is compressed (such compression being determined by the length of the damper bellow). In this position, the wad receives the small-shot charge in its upper part, and it is ready to be shot.

Taking all of the above into consideration, when the gun is shot the damper-shutter (8) works by flexion of the bellowshaped walls (9) and by the friction produced against the walls of the case or the gun. When the bellow of the damper-shutter (8) is completely folded, the convex cone of the base of the damper-shutter (8) pushes the folded walls against the concave cone of the wall of the case; thereby producing a deformation until the walls (9) adapt to the shape of both cones. Then, the air contained and compressed in the chamber (6) will have reached the necessary pressure to open the valve (2) and expel a jet of compressed air, which impels the small-shot charge, thereby recovering part of the energy used for the damping and converting it into a useful impulse for the shot. If the valve (2) is designed so that it opens when it receives the extra pressure from the gun throttle, the valve (2) will use part of the energy accumulated during the damping to impulse the small-shot charge. Furthermore, the valve (2) will permit the wad to pass through the gun throttle as the internal resistance to compression decreases.

Since the base (4) of the case (1) and the damper-shutter (8) bottom have a convexo-concave shape, they are able to absorb radial contractions relative to the symmetry axis of the wad, thus making passage of the wad with the small-shot charge through the throttle smooth and even.

Furthermore, the valve (2) can act either instantaneously or in a progressive way by simply varying the opening pressure of the valve or the section of the air hole. Under these circumstances, it is easy to make the air flow almost instantaneously or more gradually, thereby achieving the final desired damping.

When the wad comes out from the gun, the flaps (7) tend to unfold. Such unfolding is caused by the air, which contacts the flaps (7) at a very high speed. Once the flaps (7) have unfolded, they do not stop the wad. Instead, they stabilize the wad's trajectory, making the segregation of the wad and the small-shot charge quick and smooth with a minimal distortion of the trajectory of the small-shot charge.

When the wad is suddenly segregated from the charge by the braking effect of the air, the wad will fall near the shooter; and it will no doubt be easy to determine whether the shooter has reached his target or not.

I claim:

1. A wad for a gun, the wad comprising:

(a) a damper-shutter having a side wall or walls connected to a frusto-conical bottom, said damper-shutter having an open top end; and (b) a case having a side wall or walls connected to a base to define a space for holding a small shot charger, said base having a substantially conical recess in a rear surface thereof the side wall or walls of said damper-shutter being connected to said case proximate the base of said case to define a chamber within said damper-shutter, the bottom of said damper-shutter presenting a convex profile to said chamber, said convex profile being spaced from the base of the case the wall or walls of said damper-shutter being deformed by the bottom of said damper-shutter when the gun is shot, so that the wall or walls of the damper-shutter substantially conform to the base of the case and the bottom of the damper-shutter.

2. A wad as claimed in claim 1, wherein the base has a valve and the damper-shutter has a chamber containing air, the air in the chamber being compressed and forced through the valve when the gun is shot.

3. A wad as claimed in claim 1, wherein the damper-shutter has sinusoidally curved walls to facilitate folding of the walls when the gun is shot.

4. A wad as claimed in claim 1, wherein the base is frusto-conical, said base presenting a concave profile to said chamber.

5. A wad as claimed in claim 1, wherein the base of the case has frusto-conical inner wall.

6. A wad as claimed in claim 4, wherein the base of the case has frusto-conical inner wall.

7. A wad for a gun, the wad comprising:

(a) a case having a side wall or walls connected to a base to define a space for holding a small-shot charge, the base having a valve; and (b) a damper-shutter having a side wall or walls connected to a bottom, said side wall or walls of said damper-shutter being connected to the case proximate the base of said case to define a chamber containing air within said damper-shutter, the bottom of said damper-shutter presenting a convex profile to said chamber, said convex profile being spaced from the base of the case, the air in the chamber being compressed and forced through the valve when the gun is shot.

8. a wad as claimed in claim 7, wherein the damper-shutter has sinusoidally curved walls to facilitate folding of the walls when the gun is shot.

9. A wad as claimed in claim 8, wherein said wall or walls of said damper-shutter have an upper part, said damper-shutter being connected to the base of said case at said upper part, said upper part having a double-lipped edge with a ring-shaped slot to facilitate a water-tight connection between the damper-shutter and the case.

10. A wad as claimed in claim 7, wherein the damper-shutter has a frusto-conical bottom, the wall or walls of the damper-shutter being deformed by the bottom when the gun is shot.

11. A was as claimed in claim 10, wherein the base is frusto-conical, said base presenting a concave profile to said chamber.

12. A wad as claimed in claim 10, wherein the base of the case has frusto-conical inner wall.

13. A wad as claimed in claim 7, wherein said wall or walls of said damper-shutter have an upper part, said damper-shutter being connected to the base of said case at said upper part, said upper part having a double-lipped edge with a ring-shaped slot to facilitate a water-tight connection between the damper-shutter and the case.

14. A wad as claimed in claim 10, wherein said wall or walls of said damper-shutter have an upper part, said damper-shutter being connected to the base of said case at said upper part, said upper part having a double-lipped edge with a ring-shaped slot to facilitate a water-tight connection between the damper-shutter and the case.

15. A wad for a gun, the wad comprising:

(a) a case having a side wall or walls connected to a base to define a space for holding a small-shot charge; and (b) a damper-shutter having a side wall or walls connected to a bottom, said side wall or walls of said damper-shutter being connected to the case proximate the base of said case to define an empty chamber within said damper-shutter, the bottom of said damper-shutter presenting a convex profile to said chamber, the damper-shutter having sinusoidally curved walls/so facilitate folding of the wall or walls of said damper-shutter against the base of the case and the bottom of the damper-shutter when the gun is shot.

16. A wad as claimed in claim 15, wherein the case has a base with a valve and the damper-shutter has a chamber containing air, the air in the chamber being compressed and forced through the valve when the gun is shot.

17. A wad as claimed in claim 16, wherein said wall or walls of said damper-shutter have an upper part, said damper-shutter being connected to the base of said case at said upper part, said upper part having a double-lipped edge with a ring-shaped slot to facilitate a water-tight connection between the damper-shutter and the case.

18. A wad as claimed in claim 15, wherein damper-shutter has a frusto-conical bottom, the wall or walls of the damper-shutter being deformed by the bottom when the gun is shot.

19. A wad as claimed in claim 18, wherein the base is frusto-conical, said base presenting a concave profile to said chamber.

20. A wad as claimed in claim 18, wherein the base of the case has frusto-conical inner wall.

* * * * *

UNITED STATES PATENT AND TRADEMARK OFFICE

CERTIFICATE OF CORRECTION

PATENT NO. : 5,792,979
DATED : August 11, 1998
INVENTOR(S) : Pedro Diaz Prieto

It is certified that error appears in the above-identified patent and that said Letters Patent is hereby corrected as shown below:

Title page, left column, item [76], Please change the name of the inventor from "Pedro Diaz Pietro" to --Pedro Diaz Prieto--.

Signed and Sealed this

Fifteenth Day of December, 1998

*Attest:*

*Attesting Officer*

BRUCE LEHMAN

*Commissioner of Patents and Trademarks*